US006998535B2

(12) United States Patent
Nichol

(10) Patent No.: US 6,998,535 B2
(45) Date of Patent: Feb. 14, 2006

(54) METAL FOAM CASTING APPARATUS AND METHOD

(75) Inventor: Scott Nichol, Etobicoke (CA)

(73) Assignee: Cymat Corporation, Mississauga (CA)

( * ) Notice: Subject to any disclaimer, the term of this patent is extended or adjusted under 35 U.S.C. 154(b) by 0 days.

(21) Appl. No.: 10/503,332

(22) PCT Filed: Jan. 31, 2003

(86) PCT No.: PCT/CA03/00117

§ 371 (c)(1),
(2), (4) Date: Mar. 23, 2005

(87) PCT Pub. No.: WO03/064711

PCT Pub. Date: Aug. 7, 2003

(65) Prior Publication Data

US 2005/0161188 A1 Jul. 28, 2005

Related U.S. Application Data

(60) Provisional application No. 60/352,874, filed on Feb. 1, 2002.

(51) Int. Cl.
*B22D 27/00* (2006.01)

(52) U.S. Cl. ..... 174/79; 164/136; 164/335; 75/415

(58) Field of Classification Search ..... 164/79, 164/136, 335; 75/415
See application file for complete search history.

(56) References Cited

U.S. PATENT DOCUMENTS

| | | | | |
|---|---|---|---|---|
| 5,221,324 | A | 6/1993 | Jin et al. | 75/415 |
| 5,281,251 | A | 1/1994 | Kenny et al. | 75/415 |
| 5,334,236 | A | 8/1994 | Sang et al. | 75/415 |
| 5,622,542 | A | 4/1997 | Thomas et al. | 75/415 |
| 5,865,237 | A | 2/1999 | Schörghuber et al. | 164/79 |

FOREIGN PATENT DOCUMENTS

| | | |
|---|---|---|
| DE | 4326982 | 2/1995 |
| GB | 901917 | 7/1962 |

*Primary Examiner*—Kuang Y. Lin
(74) *Attorney, Agent, or Firm*—Dorsey & Whitney LLP

(57) ABSTRACT

A method for casting articles from metal foam includes a molten metal bath and a foam forming means. The foam is drawn into a ladle, within a heated chamber, which transports a foam sample to a mold. The ladle deposits the foam sample into the mold and the mold is closed. Once cooled and hardened the formed article is removed. The system of the invention comprises a molten metal bath, a heated foam collecting chamber, a ladle for drawing a sample of the foam and for transporting the sample to a mold. The present invention provides an apparatus for carrying out.

21 Claims, 7 Drawing Sheets

METAL FOAM CASTING APPARATUS AND METHOD

BACKGROUND OF THE INVENTION

1. Field of the Invention

The present invention is directed to systems and methods for casting metal foam objects.

2. Description of the Prior Art

In the manufacture of products such as automobiles etc., there exists an increasing demand for components to be made from materials that have a high strength to weight ratio. In order to meet this demand, much emphasis has been placed on finding materials that are considerably low in weight yet high in strength for manufacturing such components. One such material that has been proposed is foamed metal.

A metal foam is generally created by generating a gas in a molten metal bath so as to form a molten metal foam. The foam is then extracted and cooled. Metal foam offers various advantages as a replacement to standard metal such as meeting the above mentioned high strength to weight ratio, high shock or impact absorbing qualities, and sound absorbing qualities. The prior art teaches various methods for producing metal foam such as in U.S. Pat. Nos. 5,221,324 and 5,622,542. The known methods of generating the gas mentioned above include, among others: (1) the use of a gas supply, which blows or injects the gas into the molten metal; (2) the use of gas generating, or foaming agents, which release gas when heated; and, (3) the use of impellers to draw the desired gas into the molten metal bath. It is also know in the art to provide the molten metal with a number of additives to assist the foam in maintaining the integrity of the formed cells.

Although the prior art provides various methods for producing metal foam slabs, which can be cut to desired dimensions, there is very little teaching of methods of forming the foam into three dimensional (3D) shapes of more complex geometries. U.S. Pat. No. 5,865,237 teaches one such method. In this reference, a metal powder and a gas evolving foaming agent are heated in a chamber to create a metal foam. While the foam is being generated, the molten mixture is forced into a mould cavity. The mixture is then allowed to continue to foam within the mould in order to ensure that the foam fills the entire volume of the cavity.

The process taught by this prior art method includes various disadvantages. Firstly, the process must be carried out in a batch manner. That is, the production of a single piece involves each of the steps of charging the chamber with the required powders, melting the powders, forcing the material into the mould, finally, completing the foaming process, cooling the mould and extracting the finished article. For this reason, the process taught in U.S. Pat. No. 5,865,237 is very time consuming. Further, the step of forcing the foaming material into a mould cavity would require a force to be applied against the foam cells. This force would inevitably result in damage to some of the cells and, therefore, reduce some of the advantage of the foam material. In addition, the patent requires the use of a piston to force the foaming material into the mould. Since the piston of the '237 patent, which is made of a metal, is maintained within the heated chamber at a temperature to maintain the molten metal in such state, it will be understood that the piston would have a tendency to seize due to damage caused by the heat. Further, the transfer of the foaming material must be done at a very specific time in the process in order to ensure that sufficient post-transfer foaming occurs. Finally, the method of forcing foaming material into the mould cavity taught by the '237 patent does not allow of precise metering of such material. As such, the size and density of the final products would not be consistent.

The present invention seeks to provide a metal foam casting system and process that mitigates at least some of the disadvantages of methods known in the art.

SUMMARY OF THE INVENTION

Thus, in one embodiment, the present invention provides a system for casting an article from a metal foam comprising: a molten metal bath;

a metal foam generator within the molten metal bath;

a chamber connected to the bath by a conduit;

a ladle in the chamber for receiving a sample of the foam;

a means for withdrawing the ladle from the chamber; and, a mould having a mould cavity having a shape that is complementary to the article.

a means for withdrawing the ladle from the chamber; and, a mould having a mould cavity having a shape that is complementary to the article.

In another embodiment, the present invention provides a method of casting an article from a metal foam comprising:

providing a molten metal;

generating a foam from the molten metal;

drawing a sample of the foam;

transporting the sample to a mould;

cooling the mould; and, withdrawing the formed article.

BRIEF DESCRIPTION OF THE DRAWINGS

These and other features of the preferred embodiments of the invention will become more apparent in the following detailed description in which reference is made to the appended drawings wherein.

DESCRIPTION OF THE PREFERRED EMBODIMENTS

Figure 1:
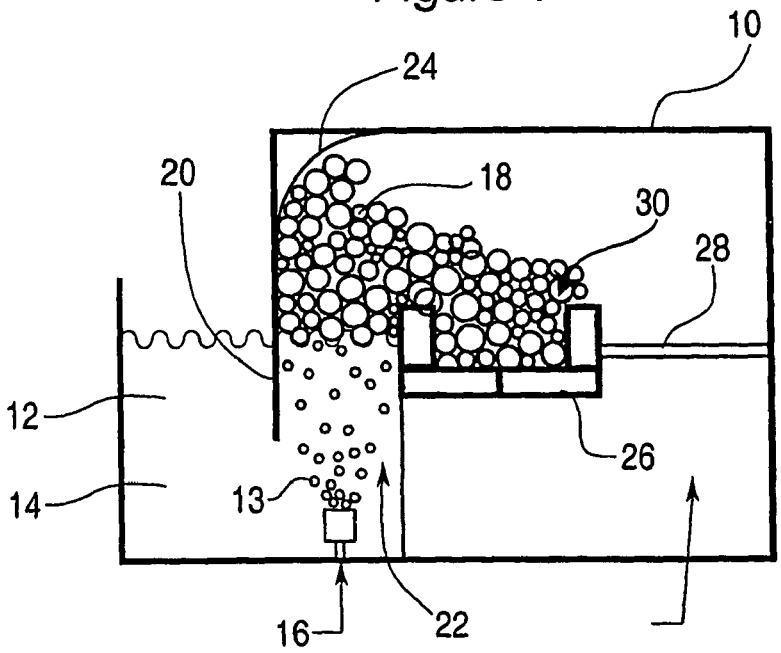
FIGS. 1 is a cross sectional view of a casting apparatus according to an embodiment of the invention in a foaming stage.

In FIG. 1, an embodiment of the system of the invention is illustrated. The system includes a heated chamber 10 that is connected to a molten metal bath 12 in which is contained a molten metal 14. The bath 12 is maintained at a temperature sufficient to maintain the metal in a molten state using any known type of heating system. A gas inlet or injection port 16 is provided at the bottom of the bath 12, through which is pumped a gas 13. The gas 13 is bubbled through the molten metal 14 thereby causing the formation of a foam 18 from the molten metal 14. The gas port 16 may include a porous nozzle which is permeable to the gas. Alternatively, the port may comprise any other known structure for allowing the gas to be bubbled through the molten metal. As is known in the art, the rising gas bubbles cause a foam 18 to form on the top surface of the molten metal 14.

In a preferred embodiment, the bath 12 is divided into two sections by means of a dividing wall 20, thereby creating a foam forming section 22 of the bath. As shown, the gas port 16 is preferably positioned under the foam forming section 22 so as to cause the foam 18 to form in section 22. It will be appreciated that the foam formation will preferentially occur in section 22 due to the generally vertical rise of the gas bubbles 13. In order to ensure this, dividing wall 20 is partially submerged in the molten metal 14.

Dividing wall 20 includes a curved diverter 24, which is one example of a means for directing the rising foam 18 towards the heated chamber 10. Within the chamber 10, a foam transfer container or ladle 26 is provided. The ladle 26 is connected to a reciprocating rod 28, which causes the ladle to move laterally within the chamber 10. It will be understood that any other means for moving the ladle 26 may be used. As shown in FIG. 1, the ladle 26 is first positioned proximal to a side wall of the bath 12. Further, the ladle 26 is provided within the chamber 10 so that the opening 30 of the ladle 26 is generally at the same level as the side wall of the bath 12. Such vertical positioning is provided to enable the foam 18 directed by the diverter 24 to enter into and fill the ladle 26. It will be appreciated that any other orientation of the ladle 26 is possible while still enabling the filling of same with the foam 18. For example, in another embodiment, the ladle can be positioned slightly above the bath 12 or a further diverter mechanism can be utilized to cause foam to fill the ladle 26. In yet another embodiment, the foam 18 can be scooped or otherwise provided into the ladle. It will also be understood that the diverter 24 can be of any shape or orientation for serving the purpose mentioned above.

Figure 2:
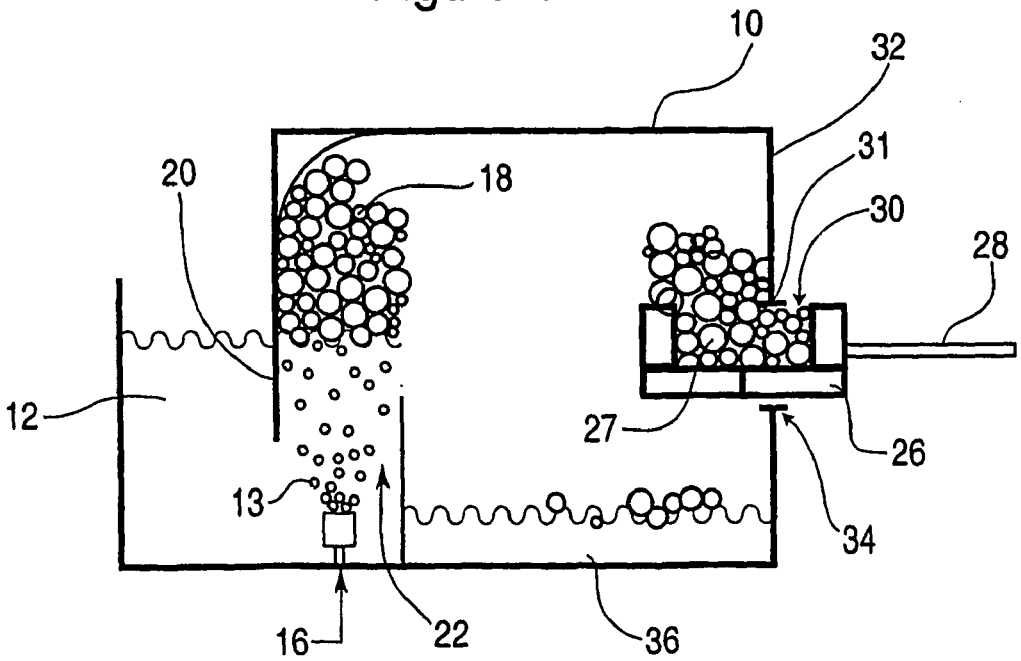
FIGS. 2 is a cross sectional view of a casting apparatus after a foam sample is withdrawn.

Once the ladle 26 is filled with a sample 27 of foam, the rod 28 is withdrawn thereby withdrawing the ladle from the chamber 10. FIG. 2 illustrates the system of the invention with the ladle 26 withdrawn. As illustrated a side wall 32, opposite the bath 12, of the heated chamber 10 is provided with a closable opening 34 through which the ladle 26 can be passed. As will be understood, the opening 34 is preferably maintained in a closed position, as shown in FIG. 1, until the ladle 26 is to pass through, as shown in FIG. 2. In this manner, heat loss from the chamber 10 is minimized. However, it will be appreciated that the opening 34 may also be kept open and other means utilized to maintain the temperature within the chamber 10. Further, as shown in FIG. 2, the opening 34 is dimensioned so as to minimize clearance of the ladle 26. In this manner, as the ladle 26 is withdrawn, the upper end 31 of the opening serves to scrape off any foam that exceeds the height of the ladle opening 30. In this manner, the volume of the foam sample 27 withdrawn by the ladle 27 is consistent from one extraction to another. Furthermore, by using such a scraping action and not compacting the foam into the ladle, the integrity of the cells forming the foam is maintained.

As will also be understood, the purpose maintaining the chamber 10 in a heated state is to ensure that the foam 18 is not allowed to cool and solidify until the forming stage is complete (as will be described further below). In a preferred embodiment, the chamber 10 is maintained at a temperature of approximately 500–700° C.

FIG. 2 also illustrates a pool 36 of molten metal and foam that spills from the bath 12, which collects at the bottom of the chamber 10. It will be appreciated that such spillage may be recycled back to the bath 12.

Figure 3:
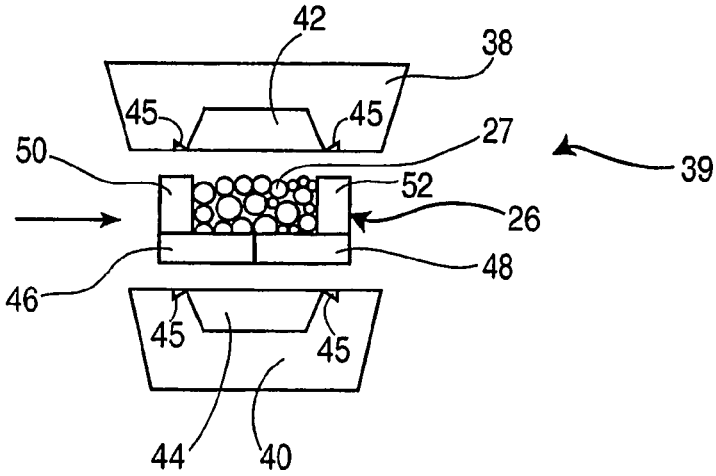
FIG. 3 is a cross sectional view of a mould in an open position with a foam transfer container.

FIG. 3 illustrates the ladle completely withdrawn from the chamber 10 and positioned between two halves of a mould 39. The mould 39 includes a first half 38 and a second half 40. Each half of the mould 39 is provided with a cavity, 42 and 44 respectively, which together form a mould cavity that conforms to the outer shape of the article to be formed. Each of the cavities 42 and 44 are also provided with a partial notch 45. When the mould halves are brought together, the notches 45 combine to form an overflow space around the article. This will be described further below.

Once the ladle is positioned between the mould halves as in FIG. 3, the contents of the ladle must then be poured into one of the cavities in the mould halves. Preferably, the mould halves are provided below and above the ladle so that the ladle need simply be emptied into the lower mould cavity.

Figure 4:
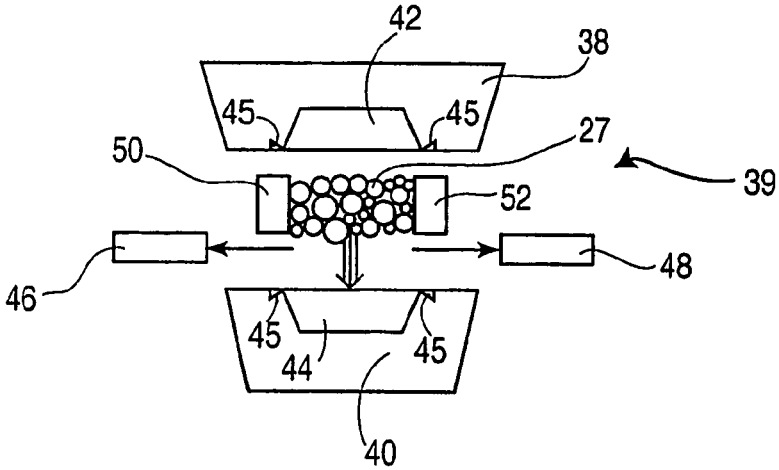
FIGS. 4 and 5 are cross sectional views of the mould in two stages of removal of the container.
Figure 5:
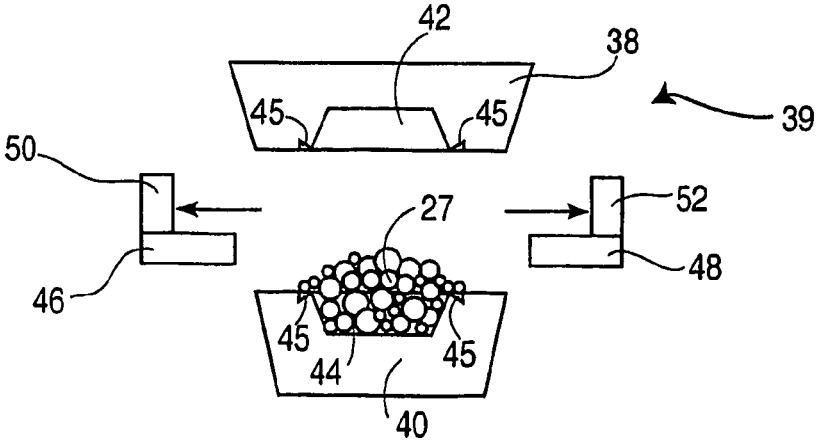

FIGS. 3 to 5 illustrate a preferred embodiment of the ladle 26 which is designed to facilitate the emptying of the foam sample 27 into the mould cavity. In this embodiment, the ladle is formed in four sections, two pieces forming the base, 46 and 48, and two pieces forming the sides, 50 and 52. When the pieces 46, 48, 50 and 52 are connected together, they form the complete ladle as shown in FIG. 3. When the foam sample 27 is to be emptied into the mould cavity, the ladle 26 is dismantled by disconnecting the various pieces. In one embodiment, as shown in FIGS. 4 and 5, the dismantling process begins with the base pieces 46 and 48 first being separated, by sliding them away from each other, followed by separation of the side pieces 50 and 52 in a similar manner. The initial removal of the base pieces ensures that the foam sample 27 is maintained in the desired size for pouring into the mould cavity.

Figure 6:
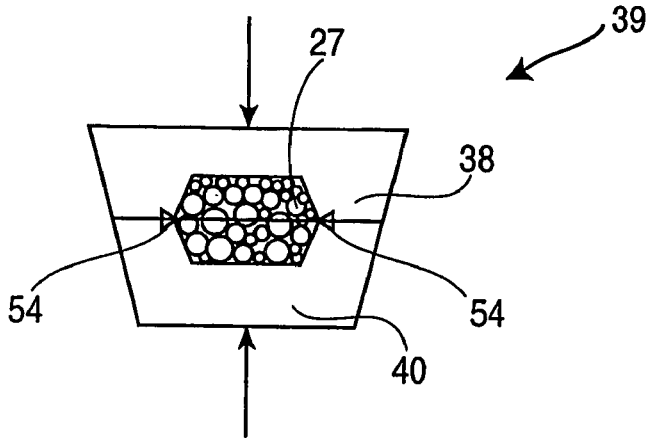
FIG. 6 is a cross sectional view of the mould in a closed position.

FIG. 6 illustrates the mould 39 in a closed position, enclosing the foam sample 27 within the mould cavity. As shown, when the mould 39 is in the closed position, the notches 45, described above, combine to form an overflow space 54 into which flows any excess foam that exceeds the volume capacity of the mould cavity. After the mould is cooled, the formed metal foam article can be removed.

In the preferred embodiment, the mould 39 is formed of sand as is commonly known in the art. Sand offers various advantages when forming moulds, including low material and mould manufacturing cost and also very low heat transmission. With regard to the latter aspect, as a poor heat transmitter, sand would allow the foam within the mould to remain at its near molten state temperature. However, it will be understood that the sand mould can be replaced with a steel mould as well. Such steel moulds would require heating as is known in the art to prevent premature cooling and hardening of the foam. Methods for using steel moulds are taught, for example, in U.S. Pat. No. 5,865,237.

It will be understood that during the transfer of the foam sample 27 from the heated chamber into the closed mould, the foam should be maintained at a molten temperature in order to keep the foam in a formable molten state. In a preferred embodiment, cooling of the molten foam is prevented by rapidly transferring the foam sample to the mould and completing the casting process. Such rapid transfer avoids the need for any external heat requirements. Moreover, since the mould is preferably made of sand held together with moisture, any external heat would lead to evaporation of the moisture and collapse of the mould. In another embodiment, the region where the ladle is moved may be heated in a manner similar to the chamber 10 so as to prevent the foam sample from cooling. In such case, it will be understood that, in the event that a sand mould is used, the mould itself would not be heated for the reasons mentioned above. Further, where metal moulds are used, it will be appreciated that the entire region of passage of the ladle and the mould itself can be heated to the desired temperature. In such case, the mould can be cooled after closure to enable hardening of the cast foam.

Figure 7A:
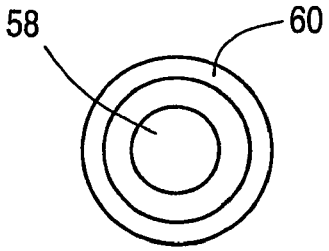
FIGS. 7A and 7B are top and side cross sectional views, respectively, of a foam article prior to trimming.
Figure 7B:
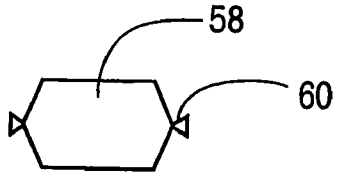

FIGS. 7 A and B illustrate a top and side view, respectively, of a foam article 58 removed from the mould of FIG. 6. As shown, the article 58 includes a ring 60 comprising the excess foam that was contained in the overflow space 54.

Figure 8:
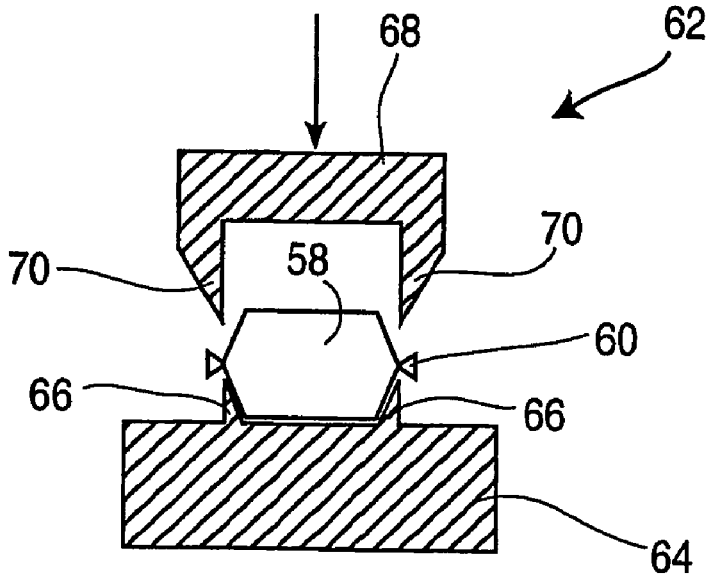
FIG. 8 is a cross sectional view of a trim press.

FIG. 8 shows a trim or nipping press 62 for removing the ring 60 on the formed article. The press 62 includes a base 64 for supporting the article 58, having a first blade 66. The article is positioned on the base 64 so that the ring 60 rests on the first blade 66. The press also includes a pressing portion 68, having a second blade 70, which cooperates with first blade 66 to form a nip. The base 64 and pressing portion 68 are both provided with a cavity between their respective blades to accommodate the article 58. In operation, the article 58 is positioned on the base 64 as indicated previously. The pressing portion 68 is then moved towards the base 64 so that the two blades are brought into contact. In this manner, the ring 60, is nipped or trimmed off the article 58 by the cutting action of the cooperating blades 66 and 70.

Figure 9A:
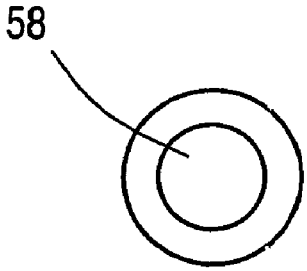
FIGS. 9A and 9B are top and side cross sectional views, respectively, of a foam article after trimming.
Figure 9B:
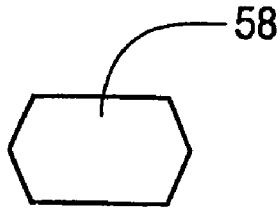

FIGS. 9 A and B illustrate the article after the trimming process.

In the above description, the foaming process has been described as using a gas supply port in the molten metal bath. However, it will be appreciated that any other foaming process may be used. For example, as taught in U.S. Pat. No. 5,865,237 and other references, a metal foam may be generated using foaming agents in a molten metal instead of a gas supply means. Further, the molten metal may be supplied with various additives that are know to stabilize the foam formed there from. In another embodiment, an impeller may be provided in the bath 12, which draws air into the molten metal. In other embodiments, the gas port 16 of the invention may also comprise a rotating impeller or a vibrating nozzle.

It will be understood by persons skilled in the art that the present invention can be used to form articles from metal foams of varying densities. The density of the foam (which is a function of the size and wall thickness of the cells forming the foam) will depend on a variety of factors such as the speed of gas addition, the amount and type of foaming additives added to the molten metal.

Figure 10:
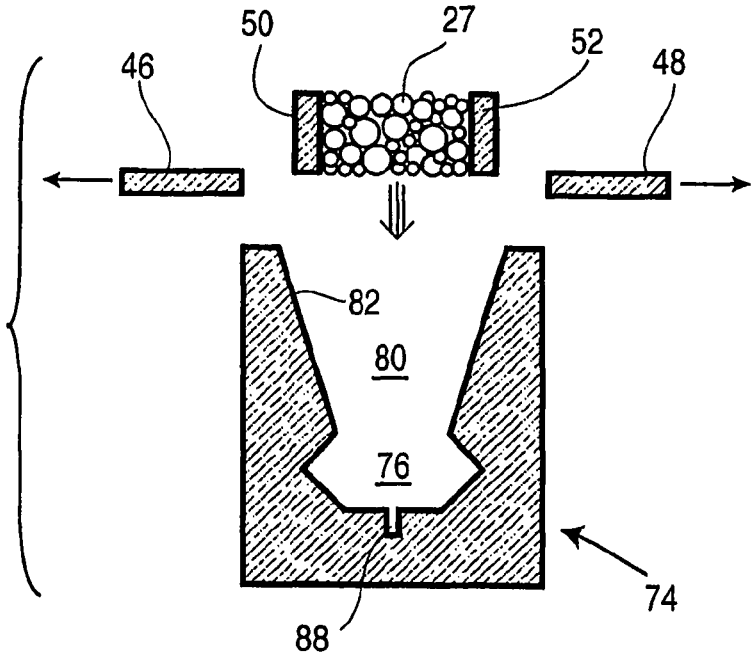
FIGS. 10 and 11 are cross sectional views of another embodiment of a mould of the invention.
Figure 11:
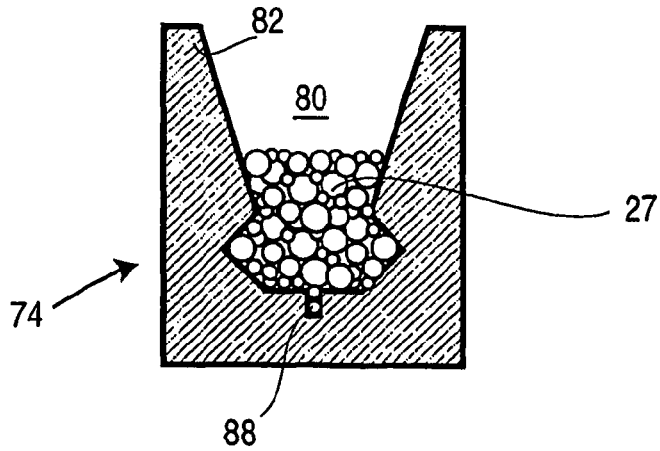

Another embodiment of the mould of the invention is shown in FIGS. 10 and 11, wherein elements common to previous figures are shown with common reference numerals. In this embodiment, a mould is shown generally at 74. The mould 74 includes a die region 76, which conforms to the shape of the final object to be formed and a funnel region or riser 80. The funnel region 80 serves to guide the foam 27 from the ladle 26. As described above, the ladle 26 is preferably in four sections as described above, namely, side walls 50 and 52 and a base formed of pieces 46 and 48. In FIG. 10, the base pieces 46 and 48 are shown in the separated position, which allows the foam 27 to drop into the mould. In this process, the interior wall 82 of the funnel region 80 of the mould 74 directs the foam into the die region 76. The mould 74 may be formed with steel, ceramic, graphite, sand or other materials.

In one embodiment, a plunger (not shown) may be used to force the foam 27 into the die region 76. It will be understood that such plunger will conform to the dimensions of the funnel region 80. The plunger can be made of refractory materials. Alternatively, the mould 74 can be vibrated to force the foam 27 into the die region 76. In other embodiments, the foam can be forced into the die region using a vacuum, by applying air pressure, or by spinning the mould. Various other means will be apparent to persons skilled in the art.

FIG. 11 illustrates the mould 74 after the foam has been delivered into the die region 76. The ladle is not shown in this figure.

As can be appreciated, the mould of this embodiment does not need to be closed to form the final product. However, the mould is separable so as to enable removal of the formed product. It will also be appreciated that the proportion of the funnel region has been exaggerated in order to depict the features of the mould and that the actual proportions and dimensions will be dependent on the final product being formed and will be easily determined by persons skilled in the art.

Figure 12:
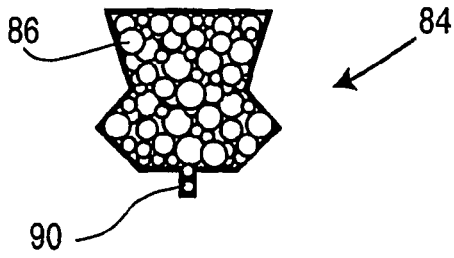
FIG. 12 illustrates an article formed with the mould of FIGS. 10 and 11.

FIG. 12 illustrates an article 84 formed in the mould of FIGS. 10 and 11. As can be seen, a portion 86 of the formed article 84 may conform to the lower portion of the funnel region 80 of the mould 74. As above, this portion 86 of the article can be easily trimmed by cutting or other means resulting in the final desired article 87, the outer shape of which corresponds to the shape of the die region or cavity 76. Again, the proportion of the trimmed portion 86 has been exaggerated in order to illustrate this embodiment.

Referring again to FIG. 10, the die region 76 of the mould 74 is provided with a vent or well 88 for collecting any liquid metal that was not foamed. FIG. 11 illustrated the well 88 wherein liquid, non-foam metal is collected. FIG. 12 illustrates a solid metal piece 90, which corresponds to the molten metal that collects in the well 88. As will be understood, such extraneous piece 90 is easily cut off from the desired finished article.

Figure 13:
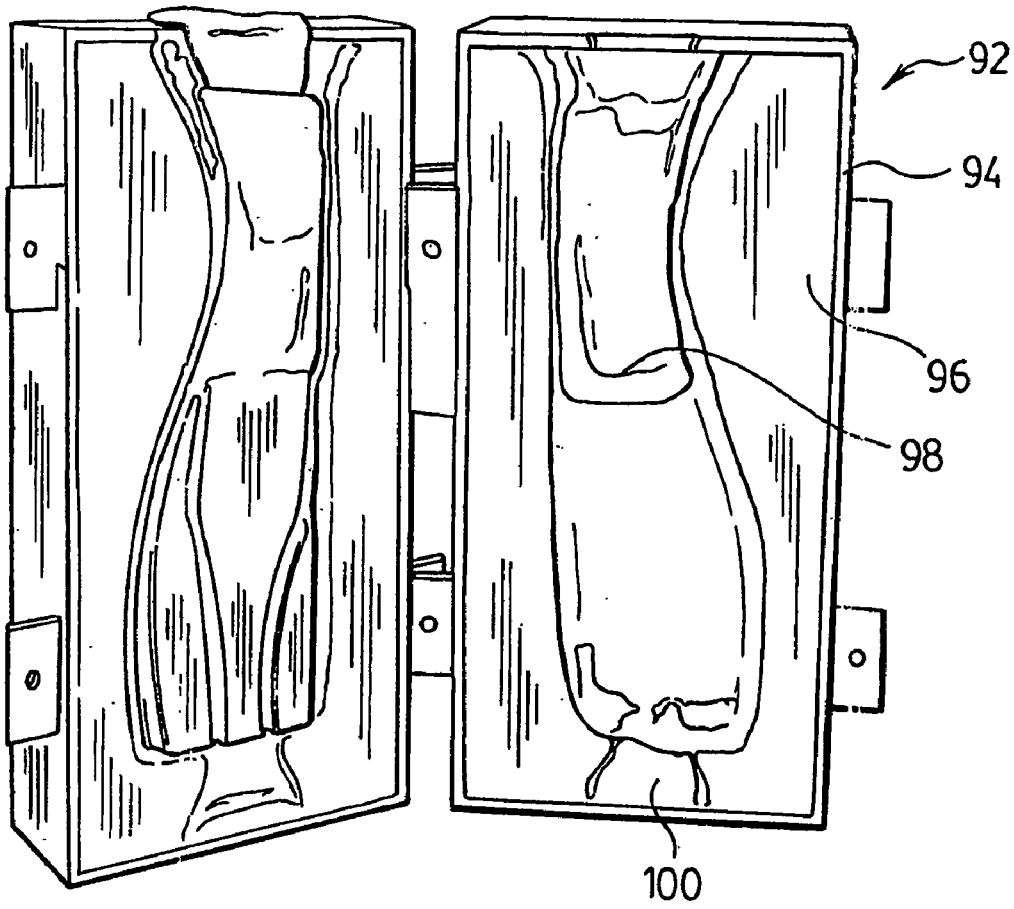
FIG. 13 is a front elevation of a further embodiment of a mould of the invention.

FIG. 13 illustrates a mould 92 in the open position, after forming the desired article. The mould comprises a metal casing 94 the inside of which is filled with sand 96. The interior portion of the mould includes a die cavity 98 formed into the sand. The upper end of the mould is provided with a funnel or guide as described above but not shown in FIG. 13. The lower end of the mould includes a well 100 as described above. The well as shown is of a "dove tail" shape.

Figure 14:
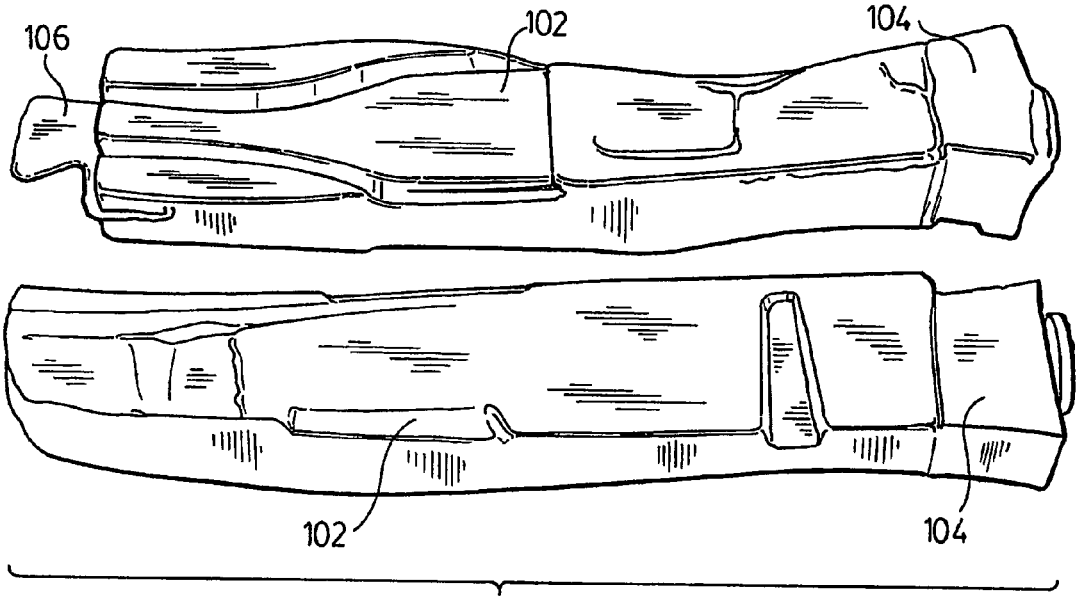
FIGS. 14 and 15 illustrate an article formed with the mould of FIG. 13.

FIG. 14 illustrates an article 102 formed in the mould of FIG. 13 prior to finishing. As can be seen, the article 102 includes a first end 104 that corresponds to the shape of a portion of the funnel (described above). A second end 106 corresponds to the liquid metal that entered the well 100.

Figure 15:
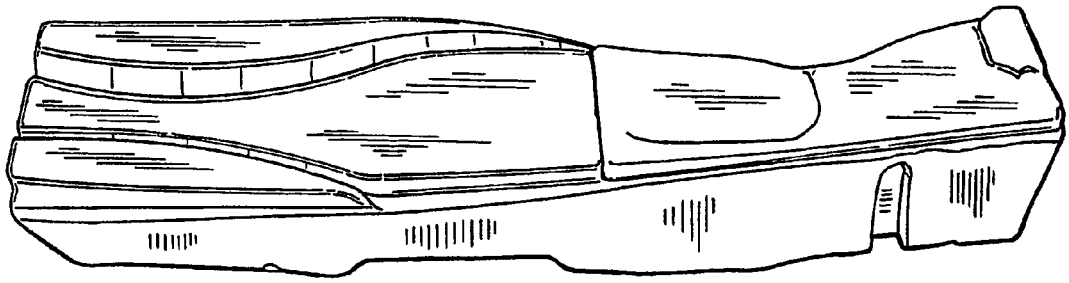

FIG. 15 illustrates the article 102 of FIG. 14 after trimming of the first and second ends.

The present invention provides a casting process that does not require the foam generation step from being halted as with the prior art. As such, the invention allows for a continuous process for generating foam, portions of which can be withdrawn and cast in a mould. It will be appreciated that in another embodiment, the system can be provided with multiple ladles each drawing samples from the same chamber but at sequential times. Such ladles would then deposit the respective samples to different moulds. In this manner, the invention provides for a continuous process for casting metal foam articles.

In the preferred embodiment, the metal is aluminum. However, it will be appreciated that any other metal may be utilized in the invention.

Although the invention has been described with reference to certain specific embodiments, various modifications thereof will be apparent to those skilled in the art without departing from the spirit and scope of the invention as outlined in the claims appended hereto. Although the invention has been described with reference to certain specific embodiments, various modifications thereof will be apparent to those skilled in the art without departing from the spirit and scope of the invention as outlined in the claims appended hereto.

The embodiments of the invention in which an exclusive property or privilege is claimed are defined as follows:

1. An apparatus for casting an article from a metal foam comprising:

a molten metal bath containing a molten metal;

a means for generating metal foam provided within said molten metal;

said means for generating a foam being provided in a foaming chamber in fluid communication with said bath;

a foam transfer container for receiving a sample of said foam generated by said means for foaming, said container being capable of reciprocating between the interior and exterior of said foaming chamber;

a means for withdrawing said foam transfer container from said foaming chamber; and, a mould having a mould cavity having a shape that is complementary to said article said mould cavity being adapted to receive said sample of foam from said foam transfer container.

2. The apparatus of claim 1 wherein said chamber is heated to maintain said foam at a molten foam state.

3. The apparatus of claim 2 wherein said metal is aluminium and said chamber is maintained at a temperature of about 500 to 700° C.

4. The apparatus of claim 1 wherein said chamber includes an opening to allow passage of said foam transfer container.

5. The apparatus of claim 1 further including a metering means for obtaining a predetermined volume of said foam sample in said foam transfer container.

6. The apparatus of claim 1 wherein said means for generating a foam comprises a gas inlet port.

7. The apparatus of claim 6 wherein said means for generating a foam comprises a gas permeable nozzle connected to a gas source.

8. The apparatus of claim 6 wherein said means for generating a foam comprises a rotating impeller having outlets for discharging said gas as bubbles into said molten metal from a gas source.

9. The apparatus of claim 1 wherein said means for generating a foam comprises a heat activated chemical foaming agent dissolved in said molten metal.

10. The apparatus of claim 1 wherein said means for generating a foam comprises a rotating impeller for drawing air into said molten metal.

11. The apparatus of claim 1 further comprising a means for extracting said foam contained in said foam transfer container.

12. The apparatus of claim 1 further comprising a means for directing said foam sample into said foam transfer container.

13. The apparatus of claim 1 wherein said foam transfer container includes a base operable between an opened and closed position and wherein transfer of said foam into the mould is achieved by opening said base.

14. The apparatus of claim 1 wherein said mould is located outside of the foaming chamber.

15. A method of casting an article from a metal foam comprising:

providing a molten metal in a molten metal bath;

generating a foam from said molten metal in a foaming chamber;

collecting a sample of said foam in a foam transfer container, said foam transfer container being capable of reciprocating between the interior and exterior of said foaming chamber;

withdrawing said foam transfer container, containing said sample of foam, from said foaming chamber;

transporting said sample of foam to a mould;

depositing said sample of foam into said mould;

cooling said mould; and, withdrawing said formed article.

16. The method of claim 15 wherein said foam transfer container is a ladle.

17. The method of claim 15 wherein said sample is of a predetermined volume.

18. The method of claim 17 wherein said predetermined volume of sample is achieved by metering the amount of foam transported to said mould.

19. The method of claim 15 further comprising trimming said formed article to remove excess material.

20. The method of claim 15 wherein said depositing of foam comprises positioning said foam transfer container above said mould and dropping said foam into said mould.

21. The method of claim 15 wherein said depositing of foam comprises forcing said foam from said foam transfer container.

* * * * *